US011808553B2

(12) United States Patent
Dorne et al.

(10) Patent No.: US 11,808,553 B2
(45) Date of Patent: Nov. 7, 2023

(54) ADVANCED PROJECTILE WITH REMOVABLE TIPS

(71) Applicant: CHEYTAC USA INC., Huntingdon, TN (US)

(72) Inventors: Robert Dorne, Huntingdon, TN (US); Blaine Campbell, Huntingdon, TN (US); Brenda Dorne, Huntingdon, TN (US)

(73) Assignee: CHEYTAC USA INC., Huntingdon, TN (US)

( * ) Notice: Subject to any disclaimer, the term of this patent is extended or adjusted under 35 U.S.C. 154(b) by 0 days.

(21) Appl. No.: 17/860,657

(22) Filed: Jul. 8, 2022

(65) Prior Publication Data

US 2023/0094300 A1 Mar. 30, 2023

Related U.S. Application Data

(60) Provisional application No. 63/220,358, filed on Jul. 9, 2021.

(51) Int. Cl.
*F42B 12/72* (2006.01)
*F42B 12/34* (2006.01)
(Continued)

(52) U.S. Cl.
CPC ..... *F42B 12/72* (2013.01); *F41H 13/0093* (2013.01); *F42B 12/207* (2013.01); *F42B 12/34* (2013.01); *F42B 12/36* (2013.01)

(58) Field of Classification Search
CPC ..... F42B 12/00; F42B 12/02; F42B 12/34; F42B 12/36; F42B 12/367; F42B 12/40;
(Continued)

(56) References Cited

U.S. PATENT DOCUMENTS 3,120,809 A * 2/1964 Custard ..... F42B 12/44 149/39
3,625,155 A * 12/1971 Douda ..... F42B 12/48 102/334

(Continued)

FOREIGN PATENT DOCUMENTS

CN 108139190 6/2018
WO WO-2018029665 A1 * 2/2018 ..... F41H 11/02

OTHER PUBLICATIONS

Shooting Surplus, "Lehigh Defense Match Solid Lead-Free Bullets Flash TIP .308" 144Gr 50/Box", (online), (Feb. 27, 2020), Retrieved from the internet:https://shootingsurplus.com/308-match-solid-flash-tip-144gr-bullet-box-50/.

(Continued)

*Primary Examiner* — James S Bergin
(74) *Attorney, Agent, or Firm* — Knobbe, Martens, Olson & Bear, LLP

(57) ABSTRACT

A projectile for use in a shooting application is disclosed. In one embodiment, the projectile includes a base. The projectile also includes a body coupled to the base, wherein the body is hollow and is used to contain a payload material tailored for a specific shooting application. The projectile further includes a threaded tip coupled to the body. The threaded tip has a stem and a threaded portion, and is threaded to body to be removably coupled to the body. The threaded tip is made using a tip material tailored for the specific shooting application.

20 Claims, 5 Drawing Sheets

(51) Int. Cl.
*F42B 12/36* (2006.01)
*F41H 13/00* (2006.01)
*F42B 12/20* (2006.01)

(58) Field of Classification Search
CPC ..... F42B 12/44; F42B 12/46; F42B 12/48; F42B 12/74; F42B 12/76; F42B 12/745; F42B 30/02; F42B 99/00
USPC ..... 102/501, 517, 519
See application file for complete search history.

(56) References Cited

U.S. PATENT DOCUMENTS

| | | | | |
|---|---|---|---|---|
| 4,671,180 | A * | 6/1987 | Wallow | F42B 12/06 102/703 |
| 5,121,691 | A | 6/1992 | Nicolas | |
| 7,100,514 | B2 | 9/2006 | LeBourgeois | |
| 9,188,414 | B2 | 11/2015 | Burczynski | |
| 9,200,877 | B1 * | 12/2015 | Rubin | F42B 12/46 |
| 10,001,355 | B2 | 6/2018 | Peterson | |
| 10,684,108 | B2 | 6/2020 | Peterson et al. | |
| 10,731,950 | B2 | 8/2020 | Mercier | |
| 10,969,207 | B1 * | 4/2021 | Tanielian | H01F 7/02 |
| 11,067,374 | B2 * | 7/2021 | Hill | F42C 13/04 |
| 11,313,654 | B2 | 4/2022 | Burrow | |
| 11,359,895 | B2 | 6/2022 | Kennedy | |
| 11,359,896 | B2 | 6/2022 | Morse et al. | |
| 11,371,817 | B2 | 6/2022 | Jones | |
| 11,378,364 | B2 | 7/2022 | Peterson et al. | |
| 11,378,368 | B2 | 7/2022 | Peterson et al. | |
| 2012/0180686 | A1 * | 7/2012 | Jones | F42B 12/367 102/365 |

OTHER PUBLICATIONS

Cutting Edge Bullets, "Solid Copper Bullets Precision Hunting Bullets Accurate Match Bullets", (online) (Jan. 30, 2020), (retrieved on Feb. 13, 2023). Retrieved from the Internet: https://cuttingedgebullets.com/cutting-edge-bullet-design.

Notification of Transmittal of the International Search Report and The Written Opinion of the International Searching Authority, or the Declaration from corresponding PCT Application No. PCT/US22/36518, dated Mar. 30, 2023.

International Search Report in corresponding PCT Application No. PCT/US22/36518, dated Mar. 30, 2023.

Written Opinion of the International Searching Authority in corresponding PCT Application No. PCT/US22/36518, dated Mar. 30, 2023.

* cited by examiner

ADVANCED PROJECTILE WITH REMOVABLE TIPS

FIELD

This disclosure generally relates to the balance flight projectile technology, and more particularly, to an advanced projectile (or bullet) with a removable or changeable tip and payload which could be modified and adopted by an individual shooter or user to fit different shooting applications.

BACKGROUND

There are a broad and diverse range types of target shooting and hunting, such as Extreme Long Range (ELR) target shooting, polymer expanding tips for hunting, armor piercing (Military/Law Enforcement), armor piercing incendiary (Military/Law Enforcement), and explosive projectiles (Military/Law Enforcement). Each particular type of target shooting and hunting generally requires a different bullet (or projectile) designed and adapted for the use and application associated with that particular type of target shooting and hunting. It would be useful to have an advanced projectile (or bullet) with a flexible design to enabled the projectile (or bullet) to be modified and adopted by an individual shooter or user to fit different shooting application.

SUMMARY

A projectile for use in a shooting application is disclosed. In one embodiment, the projectile includes a base. The projectile also includes a body coupled to the base, wherein the body is hollow and is used to contain a payload material tailored for a specific shooting application. The projectile further includes a threaded tip coupled to the body. The threaded tip has a stem and a threaded portion, and is threaded to body to be removably coupled to the body. The threaded tip is made using a tip material tailored for the specific shooting application.

DETAILED DESCRIPTION

Figure 1A:
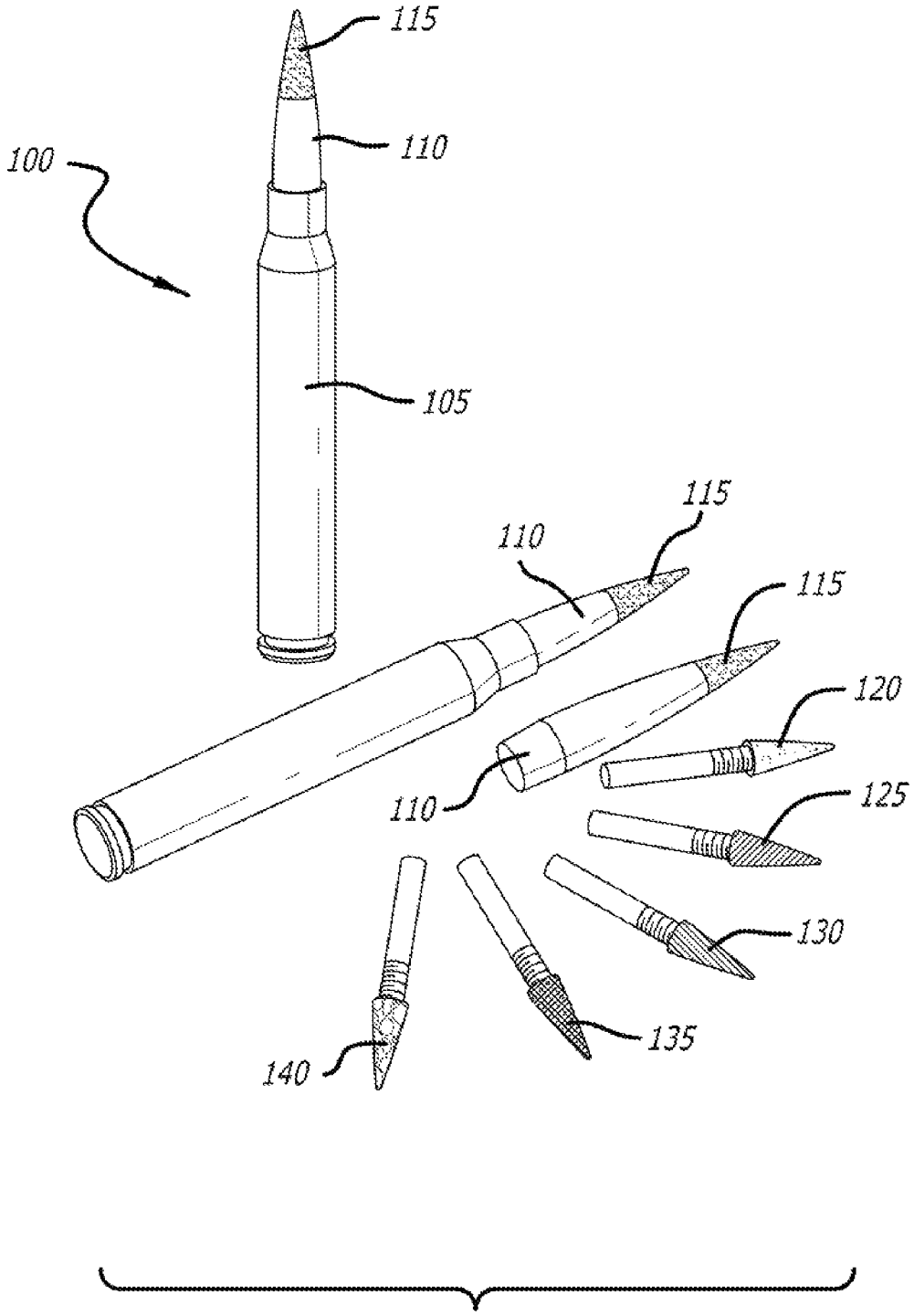
FIGS. 1A, 1B, and 1C illustrate exemplary projectiles (or bullets) according to one embodiment.
Figure 1B:
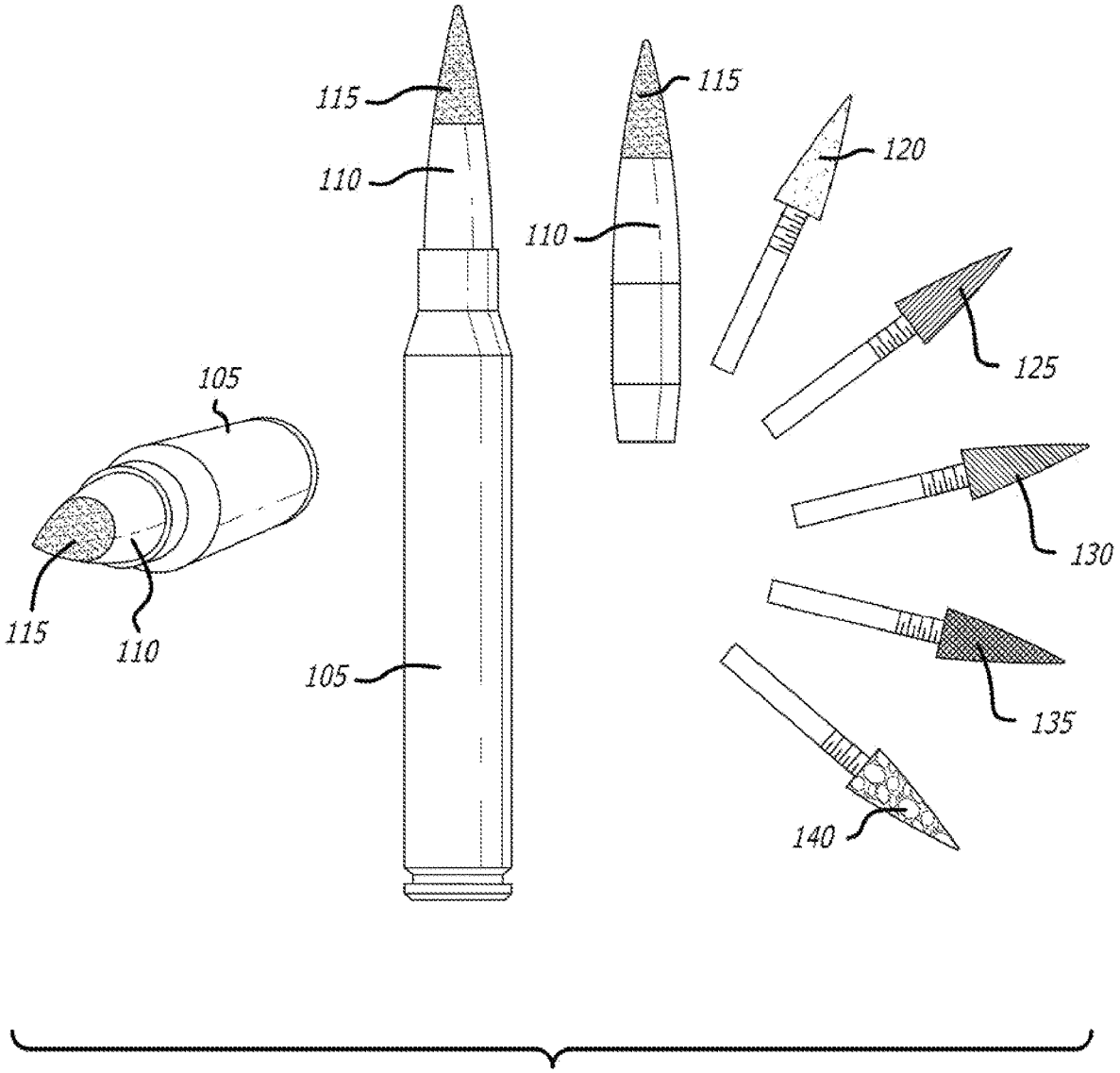
Figure 1C:
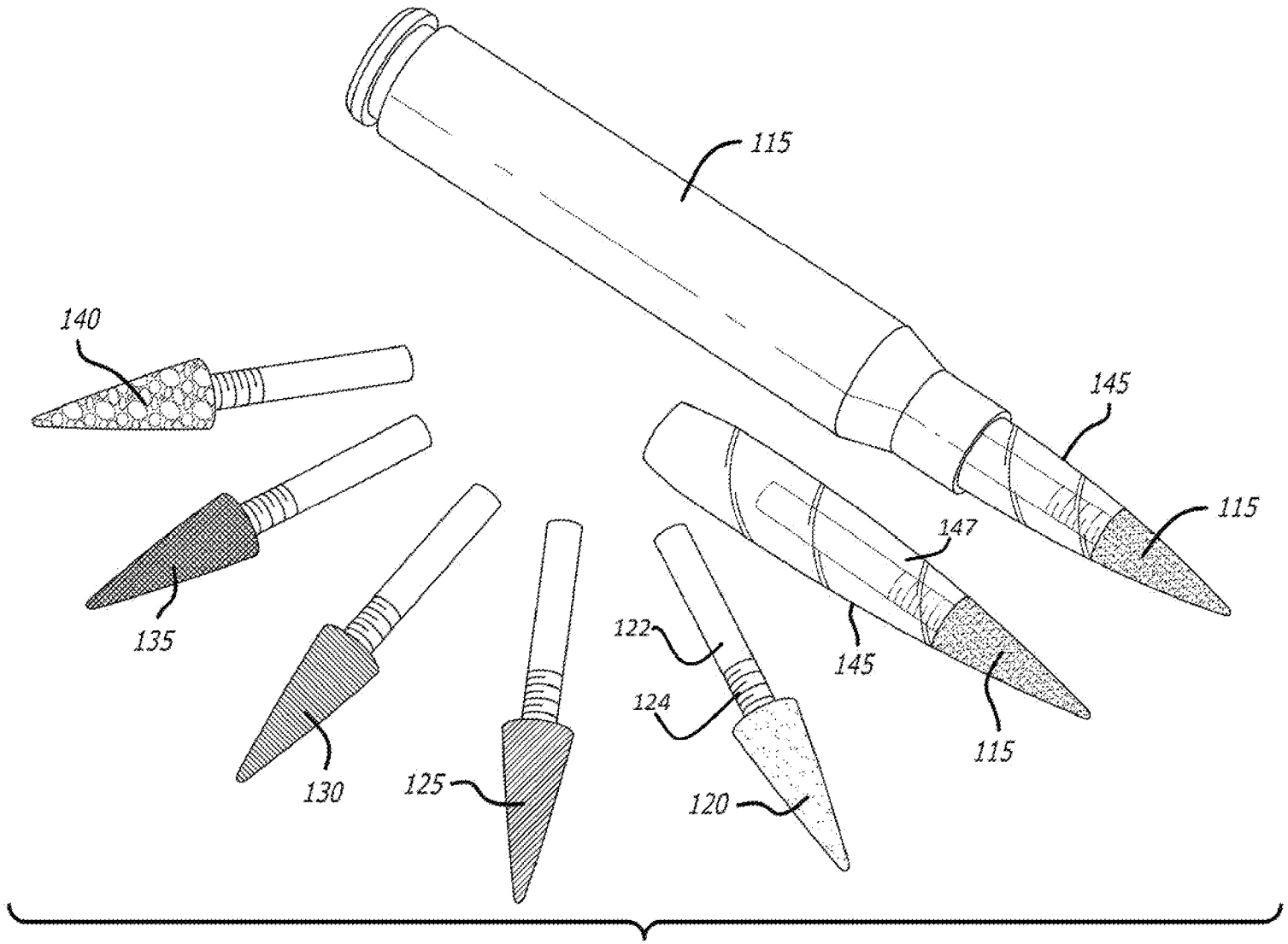

FIGS. 1A, 1B, and 1C illustrate exemplary projectiles (or bullets) according to one embodiment. As shown in FIGS. 1A, 1B, and 1C, each exemplary projectile (or bullets) 100 includes a base 105, a hollow body 110 and 145 attached to the base 105, and a removable and changeable tip 115, 120, 125, 130, 135, and 140 that is attached to the hollow body 110 and 145. The tip 115, 120, 125, 130, 135, and 140 could have different shapes and could be made using various different materials tailored for different intended uses and different applications.

In one embodiment, as shown in FIG. 1C, the removeable and changeable tip 120 has a stem 122 with a threaded portion 124. The removable and changeable tip 115, 120, 125, 130, 135, and 140 of the bullet (or projectile) 100 could be threaded to the shoulder of the hollow body 110 and 145. The empty space 147 of the hollow body 110 and 145 behind the tip 115, 120, 125, 130, 135, and 140 could be used to carry various different payloads for different applications.

In addition, the hollow body 110 and 145 (as shown in FIGS. 1A, 1B, and 1C) could be made using material for different applications. As an example, the hollow body 110 is made using an opaque material (such as copper), while the hollow body 145 is made using a clear see-through material (such as polymer).

Figure 2:
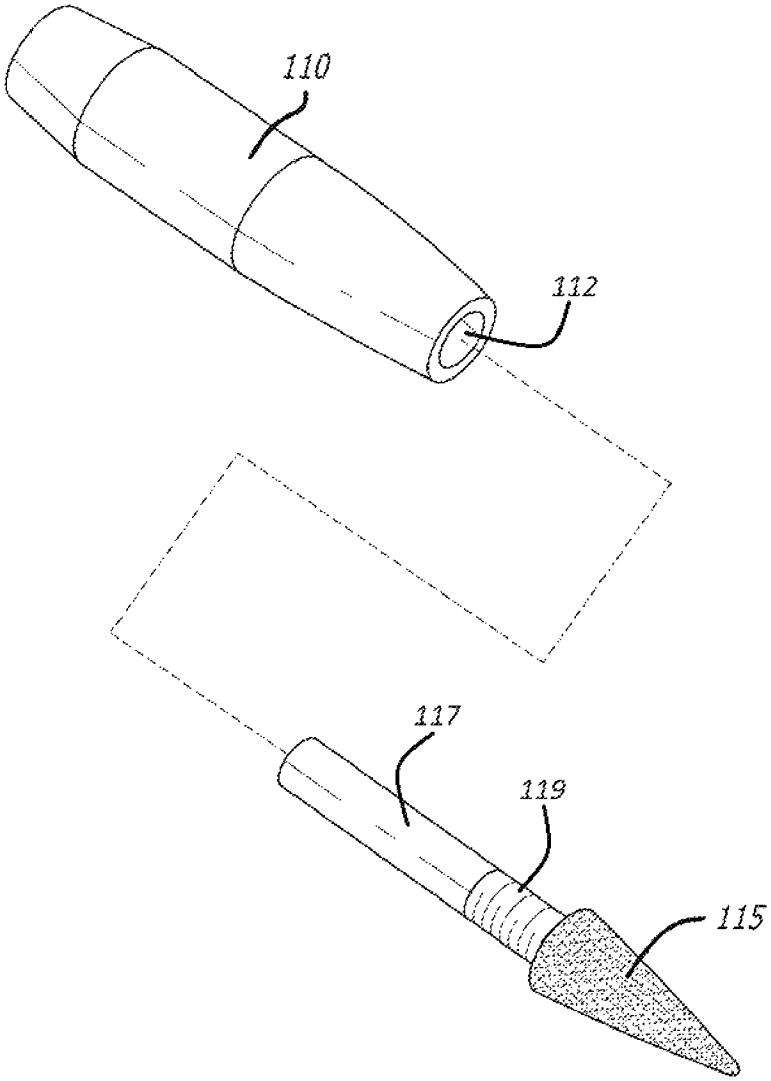
FIG. 2 illustrates an exploded view of an exemplary hollow body made of chromium copper and a magnesium threaded tip according to one embodiment.

FIG. 2 illustrates an exploded view of an exemplary hollow body 110 made of chromium copper and a magnesium threaded tip 115 according to one embodiment. As shown in FIG. 2, the tip 115 has a stem 117 with a thread portion 119. The hollow body 110 has a cavity 112 to receive the threaded tip 115. In one embodiment, the chromium copper body 110 has a density of approximately 0.320 to 0.325 pound per cubic inch, a mass of approximately 0.040 to 0.045 pound, a volume of approximately 0.125 to 0.130 cubic inch, and a surface area of approximately 2.25 to 2.30 square inches. In one embodiment, the magnesium threaded tip 115 has a density of approximately 0.060 to 0.065 pound per cubic inch, a mass of approximately 0.001 to 0.005 pound, a volume of approximately 0.030 to 0.033 cubic inch, and a surface area of approximately 0.930 to 0.935 square inch.

Figure 3A:
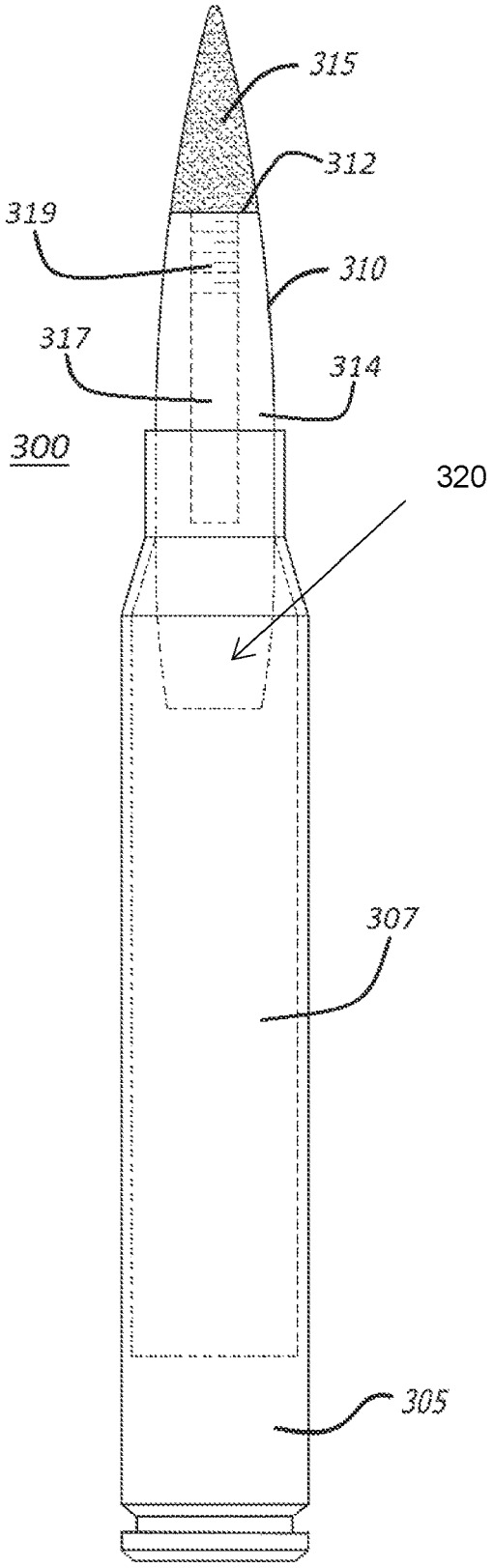
FIG. 3A is a cross-sectional side view of an exemplary projectile (or bullet) according to one embodiment.
Figure 3B:
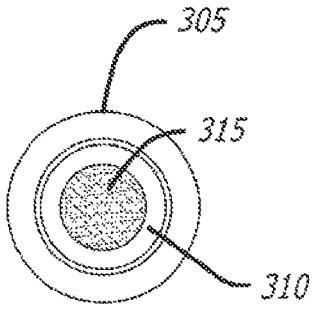
FIG. 3B is a top view of an exemplary projectile (or bullet) according to one embodiment.

FIG. 3A provides a cross-sectional side view of an exemplary projectile (or bullet) 300 according to one embodiment. FIG. 3B is a top down view of an exemplary projectile (or bullet) 300 according to one embodiment. The exemplary projectile (or bullet) 300 has a base 305 with a cavity 307 to hold propellant material (not shown). The projectile (or bullet) 300 also includes a hollow body 310 attached to the base 305, and a removable and changeable tip 315 attached to the hollow body 310. The removeable and changeable tip 315 has a stem 317 with a threaded portion 319. In one embodiment, the removable and changeable tip 315 of the bullet (or projectile) 300 could be threaded to the shoulder of the hollow body 310. Furthermore, the empty space 314 (of the hollow body 310) below or behind the base 312 of the tip 315 could be used to carry various different payloads 320 for different applications.

As discussed above, the tip (shown as elements 115, 120, 125, 130, 135, and 140 in FIGS. 1A, 1B, and 1C, and as element 315 in FIGS. 3A and 3B), the hollow body (shown as elements 110 and 145 in FIGS. 1A, 1B, and 1C, and as element 310 in FIGS. 3A and 3B), and the payloads contained or carried in the hollow bodies could have different shapes and could be made using various materials tailored for specific intended uses. The different materials could vary the weight and balance of the projectile (or bullet) to customize the projectile's particular flight characteristics, as well as impact performance on targets.

In one embodiment, the ability to change the tip of the bullet (or projectile) would, in general, allow the shooter to engage various targets of differing materials at different ranges. Furthermore, the multitude of threaded tips with different payloads would, in general, would enable a broad and diverse range of uses in target shooting and hunting, as well as military and law enforcement applications. A few exemplary applications include balanced match ballistic tips for Extreme Long Range (ELR) target shooting, polymer expanding tips for hunting, armor piercing (Military/Law Enforcement), armor piercing incendiary (Military/Law Enforcement), and explosive projectiles (Military/Law Enforcement). Possible exemplary tips and inserts could include:

Solid copper tip and insert—This tip could be used as a contiguous metal insert to the monolithic copper bullet. It creates a balanced projectile for Extreme Long Range shooting.

Low grade titanium tip and insert—This tip could be used to make an incredibly bright flash upon impact with hard surfaces for extreme long range visibility of bullet strikes. This is effective for marking targets as well as calling atmospheric deviations for ELR (Extreme Long Range) shooting.

Low grade titanium tip backed with High Melting Explosive (HMX) insert—HMX is the highest explosive currently made. It is related to Royal Demolition Explosive (RDX) but is considerably more shock resistant with a higher melting point, therefore, better suited than RDX as an explosive payload for our bullet insert. Upon surface impact, the titanium tip high temperature pressure impulse will detonate the HMX to create an explosion upon impact.

Tungsten tip penetrator and insert—Tungsten offers a 9-9.5 on the Mohs scale, 5 times harder than tool steel, and 4 times harder than titanium, this is second only to diamonds. It also offers a significant increase in weight, which in turn creates more momentum into the target. This round is generally intended for long range armor penetration.

Polymer tip and insert—This tip and insert could work basically as a ballistically aerodynamic hollow point for hunting. Upon impact, the polymer collapses in from the impact pressure which expands the bullet diameter, acting as a hollow point.

Cavitation tip and insert—This tip and insert is generally intended for underwater target engagement. It has a flat extended tip structure that, upon contact with water, creates a cavitation effect that envelopes the projectile in a layer of oxygen. This reduces the effect of water drag significantly allowing the bullet to retain speed and energy over long underwater distances.

Copper tip with mercury insert—This tip and insert is generally intended to create an electromagnetic pulse on impact with the target. When leaving the barrel, the projectile spins at over 40,000 rpm. The mercury as a liquid will not accelerate as fast as the copper case, and therefore will create a friction differentiation and accumulate electrons into the copper. These electrons will release into the target on impact creating an Electromagnetic Pulse (EMP).

In battle, the EMP payload could enable a single soldier in a ground unit to destroy enemy electronics, such as small drones, cell towers, tactical operating centers or improvised explosive devices. This EMP payload generally uses internal friction from dissimilar laminar flow of liquid metal to create a static charge inside the monolithic copper projectile. The centripetal force created by the bullet spinning at an extreme rate collects electrons into the copper which discharge on impact with an object. Furthermore, while the payload is liquid, the tip is solid and can be made of metals of differing molecular weights altering the distribution of mass in the projectile. Therefore, the round (or bullet or projectile) could be adjusted and balanced to fly different profiles and have differing impact signatures for specific targets. For instance, a tungsten tip over liquid metal would have armor piercing qualities, while a magnesium tip would be incendiary.

Extended point javelin tip and insert—This round is generally intended for supersonic impulse abatement. This tip is generally intended to mitigate the supersonic crack as heard down range at the target.

White phosphorus tip and insert—This insert is generally intended as an incendiary round, creating massive heat and continued burning upon impact. It is generally intended to set targets ablaze.

Canard nose tip with various inserts—This tip could be for a propeller type action to create thrust/stabilization also to transfer centripetal energy into forward energy slowing the bullets rotation to match its forward speed (balanced projectile theory).

Magnesium tip with hollow copper insert with HMX explosive—This tip and insert could be used for superior armor penetration. The explosive impact could create a jet of molten copper which cuts through thick armor. It could create spalling to the interior of the target. FIG. 2 illustrates an exemplary projectile (or bullet) with a chromium copper body and a threaded magnesium tip.

Copper tip with smoke insert—A round with this tip and insert could be used as a diversionary, occlusion, or marking round. As an example, rounds with this tip could be used for a semi-auto/full-auto machine gun for occlusion or diversion. Such rounds could be deployed as multiple little smoke grenades in front of the target. Such rounds could also be used in a bolt action as target marking rounds. These target marking rounds could come in multiple color options. The insert chemistry would change with different color options.

Various aspects of the disclosure have been described above. It should be apparent that the teachings herein may be embodied in a wide variety of forms and that any specific structure, function, or both being disclosed herein is merely representative. Based on the teachings herein one skilled in the art should appreciate that an aspect disclosed herein may be implemented independently of any other aspects and that two or more of these aspects may be combined in various ways. While various embodiments of the invention have been described, it will be apparent to those of ordinary skill in the art that many more embodiments and implementations are possible within the scope of this invention. Moreover, various features and functionalities described in this application and Figures may be combined individually and/or plurality of features and functionalities with others. Accordingly, the invention is not to be restricted except in light of the attached claims and their equivalents. the known and customary practice within the art to which the invention pertains.

The invention claimed is:

1. An ammunition cartridge for use in a shooting application, comprising:

a base having a cavity configured to receive and hold a propellant;

a hollow body coupled to the base, the hollow body having a chamber receiving and holding a payload material comprising a liquid metal; and a tip removably coupled to the hollow body;

wherein the tip comprises copper, tungsten, or magnesium, the body comprises copper, and wherein following launch of the tip and hollow body a difference in a rotation of the hollow body and a rotation of the liquid metal in the chamber generates an electrostatic charge in the hollow body following launch configured to release an Electromagnetic Pulse (EMP) into a target upon the tip and hollow body impacting the target.

2. The ammunition cartridge of claim 1, wherein the EMP is generated with internal friction from dissimilar laminar flow of the liquid metal to create a static charge inside the hollow body.

3. The ammunition cartridge of claim 2, wherein the liquid metal is liquid mercury.

4. The ammunition cartridge of claim 1, wherein the tip is threaded to the hollow body.

5. The ammunition cartridge of claim 4, wherein the tip has a stem that extends into the chamber of the hollow body.

6. The ammunition cartridge of claim 5, wherein the stem has a threaded portion adjacent the tip configured to threadably couple to a shoulder of the hollow body.

7. An ammunition cartridge for use in a shooting application, comprising:

a base having a cavity configured to receive and hold a propellant;

a hollow body coupled to the base, the hollow body having a chamber receiving and holding a payload material comprising a liquid metal; and a tip removably coupled to the hollow body;

wherein following launch of the tip and hollow body a difference in a rotation of the hollow body and a rotation of the liquid metal in the chamber generates an electrostatic charge in the hollow body following launch configured to release an Electromagnetic Pulse (EMP) into a target upon the tip and hollow body impacting the target.

8. The ammunition cartridge of claim 7, wherein the EMP is generated with internal friction from dissimilar laminar flow of the liquid metal to create a static charge inside the hollow body.

9. The ammunition cartridge of claim 7, wherein the liquid metal is liquid mercury.

10. The ammunition cartridge of claim 7, wherein the tip is threaded to the hollow body.

11. The ammunition cartridge of claim 10, wherein the tip has a stem that extends into the chamber of the hollow body.

12. The ammunition cartridge of claim 11, wherein the stem has a threaded portion adjacent the tip configured to threadably couple to a shoulder of the hollow body.

13. The ammunition cartridge of claim 7, wherein the hollow body comprises copper.

14. The ammunition cartridge of claim 7, wherein the tip comprises a material chosen from a group consisting of copper, tungsten, magnesium, titanium and a polymer material.

15. An ammunition cartridge for use in a shooting application, comprising:

a base having a cavity configured to receive and hold a propellant;

a hollow body coupled to the base, the hollow body having a chamber receiving and holding a payload material comprising a liquid metal; and a tip removably coupled to the hollow body, the tip being interchangeable between a plurality of different tips, each of the tips comprising a different material;

wherein following launch of the tip and hollow body a difference in a rotation of the hollow body and a rotation of the liquid metal in the chamber generates an electrostatic charge in the hollow body following launch configured to release an Electromagnetic Pulse (EMP) into a target upon the tip and hollow body impacting the target.

16. The ammunition cartridge of claim 15, wherein the EMP is generated with internal friction from dissimilar laminar flow of the liquid metal to create a static charge inside the hollow body.

17. The ammunition cartridge of claim 15, wherein the liquid metal is liquid mercury.

18. The ammunition cartridge of claim 15, wherein the tip is threaded to the hollow body.

19. The ammunition cartridge of claim 18, wherein the tip has a stem that extends into the chamber of the hollow body.

20. The ammunition cartridge of claim 19, wherein the stem has a threaded portion adjacent the tip configured to threadably couple to a shoulder of the hollow body.

* * * * *